US008691049B2

(12) United States Patent
Snekkenes

(10) Patent No.: US 8,691,049 B2
(45) Date of Patent: Apr. 8, 2014

(54) METHOD FOR AN ENERGY EFFICIENT PRODUCTION OF CELLULOSE PULP IN A CONTINUOUS DIGESTER

(75) Inventor: Vidar Snekkenes, Oslo (NO)

(73) Assignee: Valmet AB, Sundsvall (SE)

( * ) Notice: Subject to any disclaimer, the term of this patent is extended or adjusted under 35 U.S.C. 154(b) by 770 days.

(21) Appl. No.: 12/443,925

(22) PCT Filed: Nov. 5, 2007

(86) PCT No.: PCT/SE2007/050819

§ 371 (c)(1),
(2), (4) Date: Oct. 6, 2009

(87) PCT Pub. No.: WO2008/057040

PCT Pub. Date: May 15, 2008

(65) Prior Publication Data

US 2010/0071861 A1 Mar. 25, 2010

(30) Foreign Application Priority Data

Nov. 7, 2006 (SE) ..... 0602349
Nov. 5, 2007 (SE) ..... PCT/SE2007/050819

(51) Int. Cl.

| | |
|---|---|
| ***D21C 3/26*** | (2006.01) |
| ***D21C 7/14*** | (2006.01) |
| ***D21C 7/06*** | (2006.01) |
| ***D21C 7/10*** | (2006.01) |
| *D21C 3/24* | (2006.01) |
| *D21C 11/00* | (2006.01) |

(52) U.S. Cl.

CPC .. *D21C 7/14* (2013.01); *D21C 7/06* (2013.01); *D21C 7/10* (2013.01); *D21C 3/24* (2013.01); *D21C 11/0021* (2013.01)

USPC ..... 162/19; 162/29

(58) Field of Classification Search

CPC ..... D21C 3/24; D21C 7/06; D21C 7/14; D21C 11/0021

USPC ..... 162/19, 29

See application file for complete search history.

(56) References Cited

U.S. PATENT DOCUMENTS

| | | | | |
|---|---|---|---|---|
| 5,089,086 A | | 2/1992 | Silander | |
| 5,679,217 A | | 10/1997 | Outzen | |
| 5,779,856 A | * | 7/1998 | Kettunen | 162/34 |

(Continued)

FOREIGN PATENT DOCUMENTS

| | | |
|---|---|---|
| SE | WO03062525 | 7/2003 |
| WO | WO9632531 | 10/1996 |

*Primary Examiner* — Jacob Thomas Minskey

(74) *Attorney, Agent, or Firm* — Rolf Fasth; Fasth Law Offices

(57) ABSTRACT

The method is for the production of cellulose pulp in a continuous digester system. Chips are impregnated in an impregnation vessel. The chips are then fed to a subsequent digester vessel in a transfer fluid. A black liquor withdrawal is taken from the digester, which withdrawal is led to the bottom to heat the chips before the chips are fed out from the impregnation vessel. A transfer fluid is withdrawn from the digester and led to the impregnation vessel to act as an impregnation fluid. At least a portion of the transfer fluid that was withdrawn from the top of the digester passes an indirect heat exchanger, in which the transfer fluid withdrawn from the top of the digester at a temperature of at least 125° C. exchanges heat indirectly with a first fluid for the production of steam from the first fluid.

15 Claims, 4 Drawing Sheets

(56) References Cited

U.S. PATENT DOCUMENTS

| | | | | |
|---|---|---|---|---|
| 5,958,181 | A | 9/1999 | Stromberg | |
| 6,176,971 | B1 | 1/2001 | Yu et al. | |
| 6,306,252 | B1 | 10/2001 | Ryham | |
| 7,112,256 | B2 | 9/2006 | Snekkenes | |
| 2004/0060672 | A1* | 4/2004 | Snekkenes et al. | 162/19 |
| 2005/0173081 | A1* | 8/2005 | Snekkenes et al. | 162/29 |

* cited by examiner

Figur 1

Figur 2

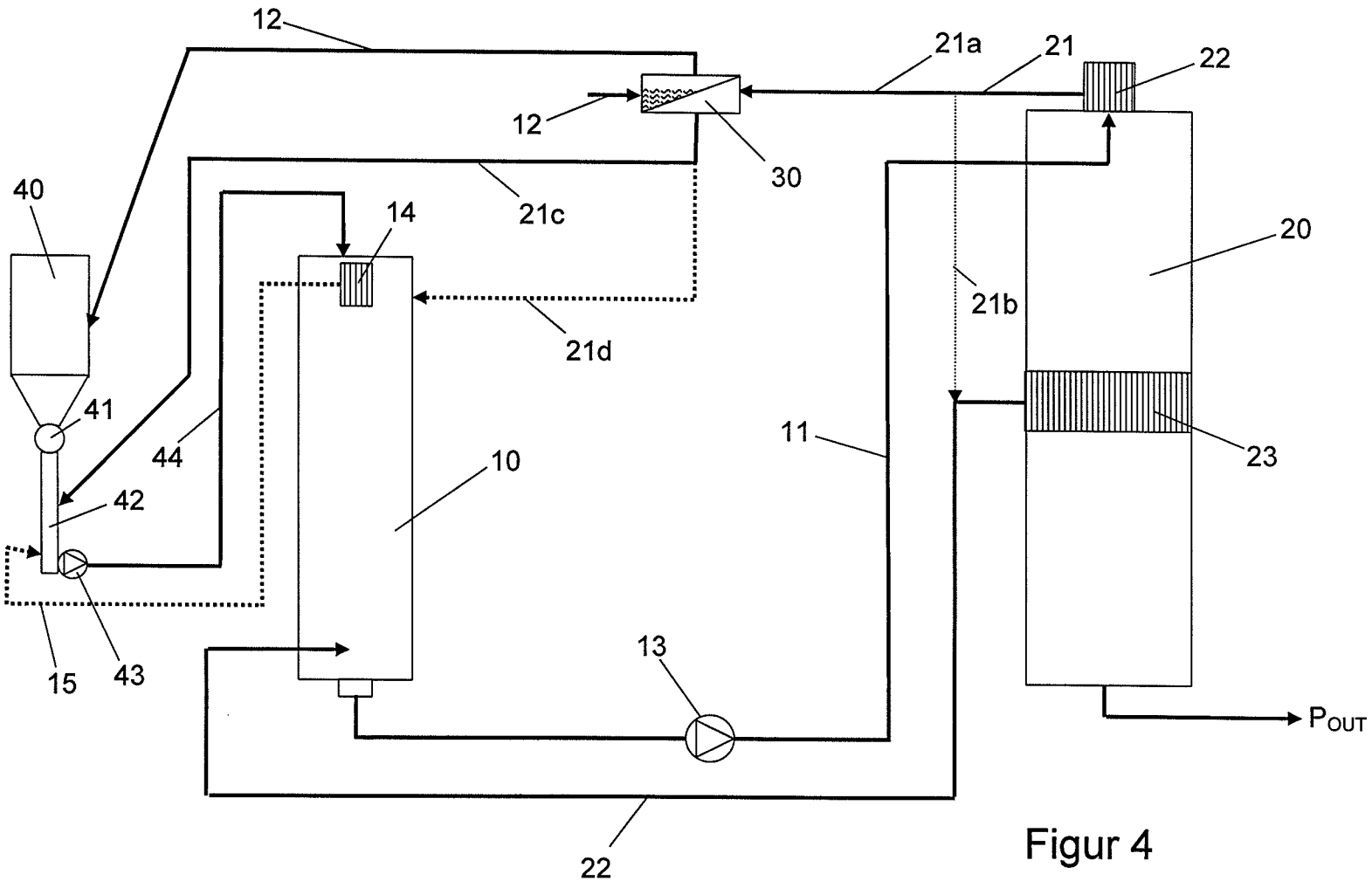
Figur 4

METHOD FOR AN ENERGY EFFICIENT PRODUCTION OF CELLULOSE PULP IN A CONTINUOUS DIGESTER

PRIOR APPLICATION

This application is a U.S. national phase application based on International Application No. PCT/SE2007/050819, filed 5 Nov. 2007, claiming priority from Swedish Patent Application No. 0602349-3, filed 7 Nov. 2006.

TECHNICAL AREA

The present invention concerns a method for the production of cellulose pulp in a continuous system in an energy-efficient manner.

BACKGROUND AND SUMMARY OF THE INVENTION

U.S. Pat. No. 7,112,256 B2 reveals a method for improving the heat economy in a continuous digestion system. The digestion system comprises an impregnation vessel and a digester. Chips are fed into the impregnation vessel and are there impregnated at a pre-determined impregnation temperature, before the impregnated chips are fed out from the impregnation vessel up to the top of the digester in order to be cooked. A dissolved cellulose pulp is fed out from the outlet at the bottom of the digester when the cooking process is complete. At least one black liquor withdrawal is taken from the digester, and this is added to the lower part of the impregnation vessel, in order to increase in this way the temperature of the chips before they are further fed upwards to the top of the digester vessel. The need to add hot steam at the top of the digester is in this way reduced. A part of the black liquor is then withdrawn from the top separator of the digester in order to be added in the impregnation vessel and there used as impregnation fluid. This invention allows the achievement of a "cold" black liquor impregnation, where the black liquor before it is taken to the impregnation vessel has to a large extent cooled by convection in the lines and through its mixing with the colder impregnation fluid and the chips. The requirement for the addition of steam at the top of the digester has at the same time been considerably reduced. FIG. 2 shows an alternative embodiment in which a cooler (21) is used to reduce even further the temperature of the black liquor that has been withdrawn from the top separator.

The use of a heat exchanger, known as a "reboiler", that generates steam in cooking processes is known. U.S. Pat. No. 6,176,971 B1 reveals a cooking process in which hot black liquor, directly withdrawn from a digester vessel (and possibly having been cooled in a heat exchanger), is used to create pure steam with the aid of a reboiler (71). The pure steam (73) is then led to a steam pre-treatment vessel (17) in order there to heat the chips. The black liquor is sent after its passage through the reboiler to a recovery process.

A cooking process is shown also in U.S. Pat. No. 6,306,252, FIG. 2, where the production of pure steam from water takes place. The black liquor in this case is withdrawn directly from the digester and it heats the water in a heat exchanger (19) before the heated water is led to flash tanks (21, 22) for the production of pure steam. The black liquor is led after its passage through the heat exchanger (19) to a recovery process.

FIG. 3 shows an alternative embodiment in which pure water is led to a pre-vaporiser (27). The water exchanges heat in the pre-steamer with hot black liquor (11), where the water is vaporised to pure steam. The pure steam can then be used in order to treat chips with steam during impregnation, while the cooled black liquor can be sent to a recovery process, can pre-treat chips in the digester, can be used as a source in order to create more pure steam, or can be flashed off in order to produce impure steam.

A first object of the present invention is to produce pure steam in order to pre-treat the chips before the chips are to be impregnated in an impregnation vessel.

A second object is to exploit a withdrawal of digestion fluid from the top of the digester with the aim of obtaining the pure steam.

A third object is to produce the pure steam by using indirect exchange of heat between the withdrawal from the top of the digester and a pure fluid, where the pure fluid is converted to pure steam.

A fourth object is to obtain by indirect heat exchange a cooling of the cooking fluid withdrawn from the top of the digester, where the cooled withdrawal is subsequently used as impregnation fluid.

A fifth object is to exploit the heat energy in a more efficient manner.

A sixth object is to obtain an impregnation process in which the impregnation fluid that is led to the impregnation vessel has a low temperature.

The invention concerns a method for the production of cellulose pulp in a continuous digester system in an energy-efficient manner. The method comprises an impregnation vessel in which to impregnate the chips, which chips are then fed to a subsequent digester vessel in a transfer fluid. A black liquor withdrawal is taken from the digester, which withdrawal is led to the bottom in order there to heat the chips before they are fed out from the impregnation vessel. A withdrawal of the transfer fluid is taken from the top of the digester and led to a position in order there to act as impregnation fluid in the impregnation vessel. The invention is characterised in that at least a portion of the transfer fluid that is withdrawn from the top of the digester passes an indirect heat exchanger, in which the transfer fluid withdrawn from the top of the digester at a temperature of at least 125° C. exchanges heat indirectly with a first fluid for the production of steam from the first fluid. The steam that is produced is then led to a steam pre-treatment position, upstream of the impregnation process, in order to heat the chips at the said steam pre-treatment position.

The following positive advantages over the prior art technology are obtained with the use of the invention:

- The impregnation fluid that is withdrawn from the digester and led to the impregnation vessel is cooled in association with the production of the steam. This is advantageous for the impregnation.
- The conversion of pure fluid to pure steam takes place in a manner that is highly energy-efficient.
- The heat energy that leaves the impregnation fluid is absorbed by the fluid that is converted to steam, while the impregnation fluid at the same time is cooled. This ensures that not only a cold impregnation but also a pre-heating of the chips by steam before impregnation are obtained in a very energy-efficient manner.

BRIEF DESCRIPTION OF THE DRAWINGS

FIG. 4 shows a fourth preferred embodiment of the invention.

DETAILED DESCRIPTION OF THE INVENTION

Figure 1:
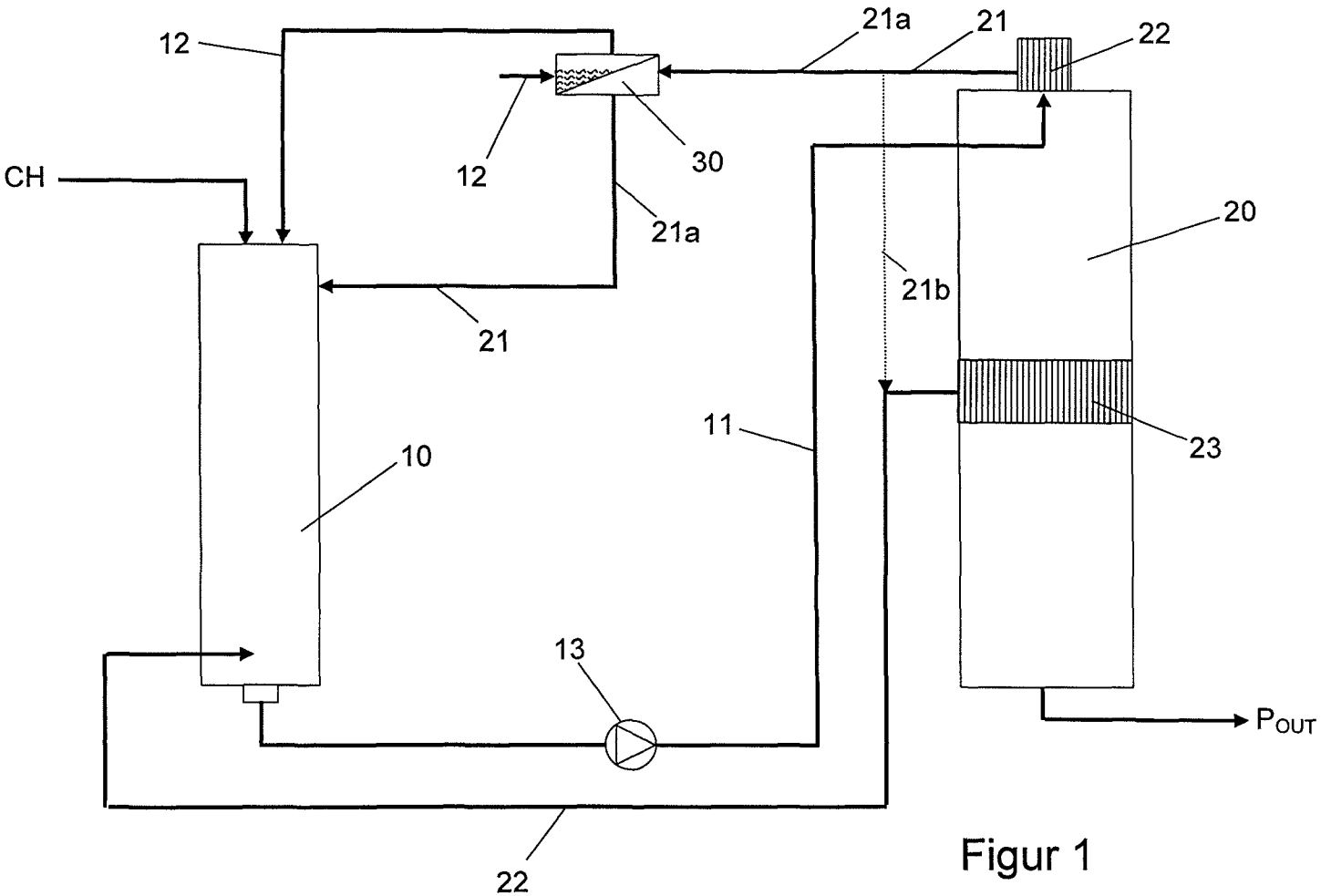
FIG. 1 shows a first preferred embodiment of the invention.

FIG. 1 shows a first embodiment of a method for the production of cellulose pulp in a continuous digester system in an energy-efficient manner. The digestion system comprises an impregnation vessel 10 with an inlet at the top of the impregnation vessel 10 and an outlet at its bottom. Cellulose chips (CH) are continuously fed to the inlet of the impregnation vessel in order to be impregnated in an impregnation fluid in the impregnation vessel 10 at a pre-determined impregnation temperature $T_{imp}$ in the interval 80-120° C. The impregnation temperature, however, is at least 20° C. lower than the subsequent cooking temperature $T_{kok}$. The impregnated chips after the completion of the impregnation are fed out from the impregnation vessel 10 through the outlet arranged at the bottom of the impregnation vessel 10.

After being fed out from the impregnation vessel 10 the impregnated chips are fed, together with a transfer fluid, in a transfer line 11 to an inlet at the top of a subsequent digester vessel 20. The pressurisation of the chips and the transfer fluid in the transfer line 11 is carried out with a pressurising means 13 such as, for example, a sluice feeder tap or with at least one pump. The chips are cooked in the digester vessel at a pre-determined cooking temperature $T_{kok}$ in the interval 130-160° C. The cooked chips are fed out from the digester vessel after the completion of the cooking process in the digester vessel 20 as a dissolved cellulose pulp, through an outlet arranged at the bottom of the digester vessel.

At least one black liquor withdrawal is carried out through a withdrawal strainer 23 in the digester vessel essentially at the maintained cooking temperature $T_{kok}$, and this withdrawal is led along a black liquor line 22 directly to the bottom of the impregnation vessel in order there to be mixed with the chips mixture of impregnated chips and impregnation fluid. The aim of leading the black liquor withdrawal to the bottom of the impregnation vessel is to raise the temperature of the chips mixture at the bottom of the impregnation vessel. The temperature of the black liquor is at least 135° C. in association with its withdrawal from the digester.

A portion of the transfer fluid is withdrawn from the top of the digester and led in a return line 21 to the impregnation vessel 10, where it is given time to work as impregnation fluid for at least 25% of the total impregnation time for the cellulose chips in the impregnation vessel. At least a portion of the transfer fluid that is withdrawn from the top of the digester passes a first indirect heat exchanger 30, in which the transfer fluid withdrawn from the top of the digester at a temperature of at least 125° C. exchanges heat indirectly with a first fluid for the production of steam from the first fluid.

The steam that is produced is subsequently led in a line 12 directly to a steam pre-treatment position at the top of the impregnation vessel 10. The steam pre-heats the chips at the steam pre-treatment position, which is upstream of the impregnation in the impregnation vessel, before the impregnation starts. The steam pre-treatment position to which the steam is led in order to steam pre-treat the chips is held at atmospheric pressure.

It is also possible for a subfraction of the transfer fluid withdrawn from the digester to be withdrawn from the return line 21, where the subfraction is led in a return line 21*b* such that it can be mixed with the black liquor withdrawal in the black liquor line 22.

Figure 2:
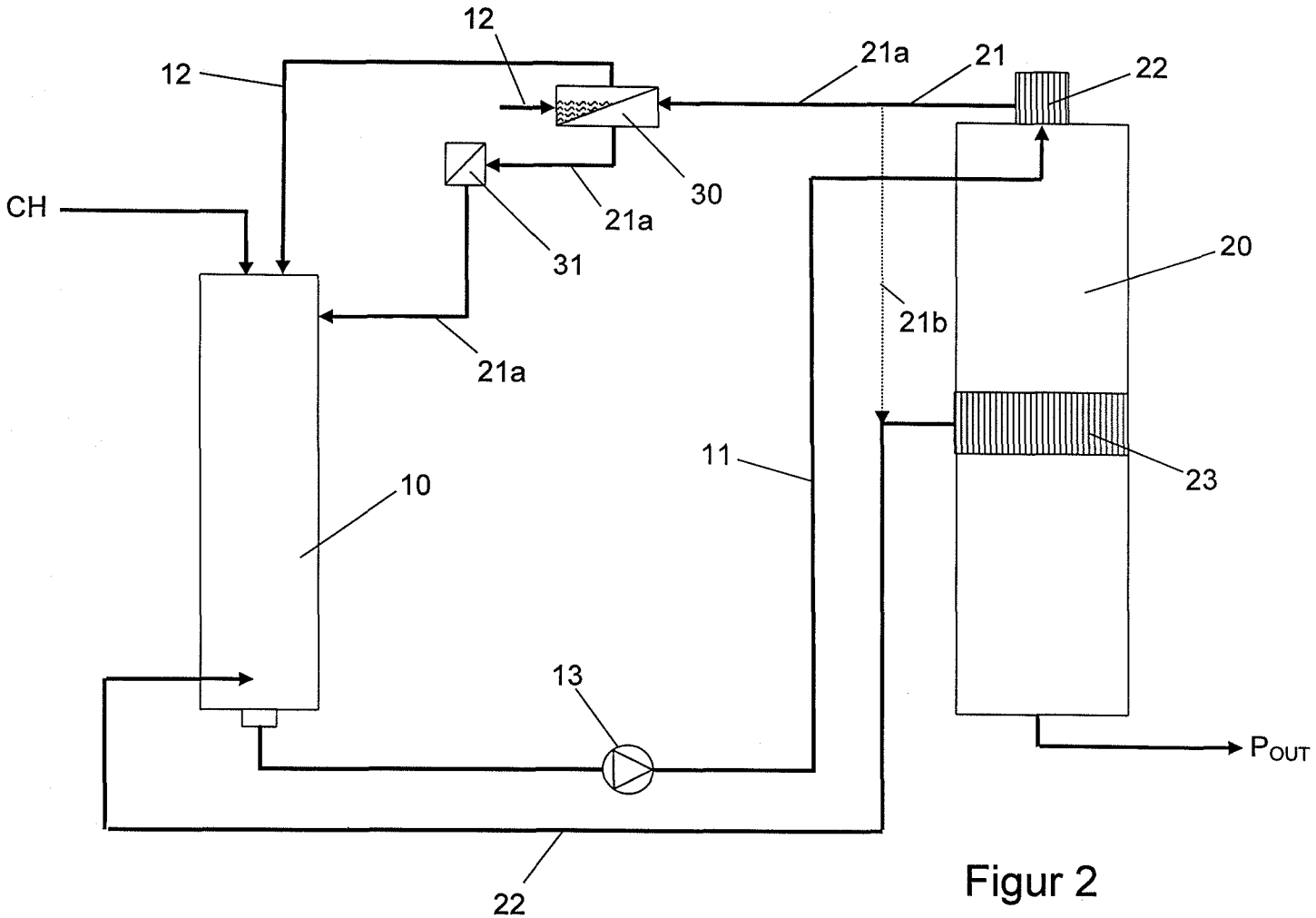
FIG. 2 shows a second preferred embodiment of the invention.

FIG. 2 shows a second preferred embodiment in accordance with the method for which a patent is applied. This embodiment is identical with the first described embodiment in FIG. 1, with the addition that a cooling stage, in the form of a cooler 31, is arranged between the indirect heat exchanger 30 and the impregnation vessel 10.

This cooler 31 can be constituted by a second indirect heat exchanger, where the transfer fluid withdrawn from the digester exchanges heat indirectly with a second fluid that is colder than the withdrawn transfer fluid.

The cooler 31 may also be constituted by a flash tank that relieves the pressure of the transfer fluid that has been withdrawn from the digester and thus reduces the temperature of this transfer fluid. Steam that contains NCGs (non-condensable gases) is also flashed in association with the flashing of the fluid. The NCGs are led after withdrawal onwards to a LVHC system and/or to destruction.

Figure 3:
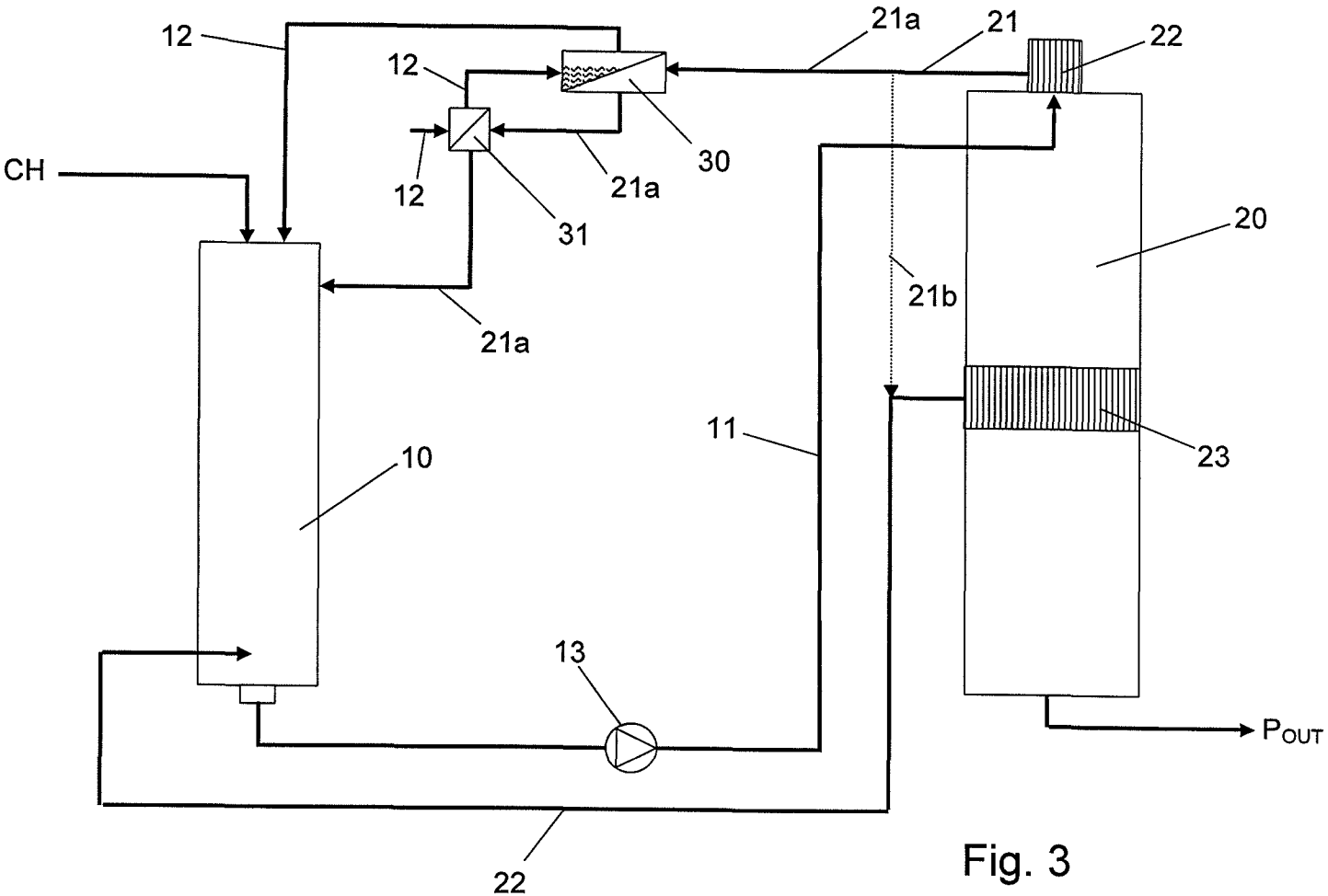
FIG. 3 shows a third preferred embodiment of the invention.

FIG. 3 shows a third preferred embodiment. This embodiment is identical with the second preferred embodiment shown in FIG. 2, where a second indirect heat exchanger 31 exchanges heat with a colder second fluid. However, in this third embodiment, the second fluid is led onwards in a line 12, after the heating of the second indirect heat exchanger, to the first indirect heat exchanger 30, in order there to be converted to steam after heat exchange with the transfer fluid withdrawn from the digester. Thus, the first fluid in the first indirect heat exchanger 30 is constituted in this third embodiment by the heated second fluid from the second indirect heat exchanger 31.

FIG. 4 shows finally a fourth preferred embodiment of the method for the production of cellulose pulp in a continuous digester system in an energy-efficient manner. The digestion system comprises the impregnation vessel 10 with the inlet at the top of the impregnation vessel 10 and the outlet at its bottom. Cellulose chips (CH) are continuously fed to the inlet of the impregnation vessel in order to be impregnated in an impregnation fluid in the impregnation vessel 10 at a pre-determined impregnation temperature $T_{imp}$ in the interval 80-120° C. The impregnation temperature, however, is at least 20° C. lower than the subsequent cooking temperature $T_{kok}$. The impregnated chips after the completion of the impregnation are fed out from the impregnation vessel 10 through the outlet arranged at the bottom of the impregnation vessel 10.

After being fed out from the impregnation vessel 10, the impregnated chips are fed, together with a transfer fluid, in a transfer line 11 to the inlet at the top of the subsequent digester vessel 20. The pressurisation of the chips and the transfer fluid in the transfer line 11 is carried out with a pressurising means 13 such as, for example, a sluice feeder or with at least one pump. The chips are cooked in the digester vessel 20 at a pre-determined cooking temperature $T_{kok}$ in the interval 130-160° C. The cooked chips are fed out after the completion of the cooking process in the digester vessel 20 as a dissolved cellulose pulp, through an outlet arranged at the bottom of the digester vessel.

At least one black liquor withdrawal is carried out through a withdrawal strainer 23 in the digester vessel essentially at the maintained cooking temperature $T_{kok}$, and this withdrawal is led along a black liquor line 22 directly to the bottom of the impregnation vessel in order there to be mixed with the chips mixture of impregnated chips and impregnation fluid. The aim of leading the black liquor withdrawal to the bottom of the impregnation vessel is to raise the temperature of the chips mixture at the bottom of the impregnation vessel. The temperature of the black liquor is at least 135° C. in association with its withdrawal from the digester.

A steam pre-treatment vessel 40 is arranged upstream of the impregnation vessel 10. Untreated chips are fed to the steam pre-treatment vessel in order there to be pre-treated with steam. After the steam pre-treatment in the steam pre-treatment vessel 40, the treated chips fall down in a fall-pipe 42 through a rotating sluice arrangement 41 arranged between the steam pre-treatment vessel 40 and the fall-pipe 42. The steamed chips are then fed onwards in a feed line 44 to the inlet of the impregnation vessel. The feed of the chips from the outlet of the fall-pipe to the inlet of the impregnation vessel here takes place with the aid of a high-pressure tap 43.

At least a part of the transfer fluid is withdrawn from the top of the digester and led in a return line to the fall-pipe 42, such that it is to be given time to act as impregnation fluid in the subsequent impregnation vessel. At least a portion of the transfer fluid that has been withdrawn from the top of the digester passes a first indirect heat exchanger 30, in which the transfer fluid withdrawn from the top of the digester at a temperature of at least 125° C. exchanges heat indirectly with a first fluid for the production of steam from the first fluid.

The steam that is produced is then led in a line 12 to a steam pre-treatment position in the steam pre-treatment vessel 40 in order there to heat the chips before they are fed onwards to the subsequent impregnation stage. The steam pre-treatment position to which the steam is led in order to steam pre-treat the chips is held at atmospheric pressure.

It is also possible that a portion of the transfer fluid that has been withdrawn from the top of the digester can, after passage of the first indirect heat exchanger 30, be withdrawn and led to a position in the impregnation vessel 10, where it is given time to work as impregnation fluid for at least 25% of the total impregnation time for the cellulose chips in the impregnation vessel.

Furthermore, a withdrawal from the impregnation vessel can be made from a top separator at the top of the impregnation vessel and led in a line 15 to the fall-pipe 42 upstream of the impregnation vessel 10.

It is also possible for a subfraction of the transfer fluid withdrawn from the digester to be withdrawn from the return line 21, where the subfraction is led in a return line 21*b* such that it can be mixed with the black liquor withdrawal in the black liquor line 22.

The first fluid and the second fluid in all of the above embodiments are preferably constituted by water.

The following advantages, among others, are achieved with the invention:

- The transfer fluid that is withdrawn from the digester and led to the impregnation vessel is cooled in association with the production of the steam. This is advantageous for the impregnation.
- The conversion of pure fluid to pure steam takes place in a manner that is highly energy-efficient.
- The heat energy that leaves the impregnation fluid is absorbed by the fluid that is converted to steam, while the impregnation fluid is at the same time cooled. This ensures that not only a cold impregnation but also a pre-heating of the chips by steam before impregnation are obtained in a very energy-efficient manner.

Several variants in addition to the embodiments described above are possible within the scope of the attached patent claims.

While the present invention has been described in accordance with preferred compositions and embodiments, it is to be understood that certain substitutions and alterations may be made thereto without departing from the spirit and scope of the following claims.

The invention claimed is:

1. A method for the production of cellulose pulp in a continuous digestion system in an energy-efficient manner, the method comprising the following steps:

providing a digester vessel having an inlet defined therein at a top thereof and an outlet defined therein at a bottom thereof;

continuously feeding chips (CH) to an inlet of an impregnation vessel;

impregnating the chips in an impregnation fluid in the impregnation vessel at a pre-determined impregnation temperature ($T_{imp}$);

feeding the impregnated chips and a transfer fluid to the inlet at the top of the digester vessel;

cooking the impregnated chips in the digester vessel at a pre-determined cooking temperature ($T_{kok}$);

feeding out dissolved pulp from the digester vessel through the outlet arranged at the bottom of the digester vessel;

withdrawing black liquor essentially at the cooking temperature ($T_{kok}$) from the digester vessel, leading the withdrawn black liquor directly to a bottom of the impregnation vessel;

mixing the black liquor with a chips mixture of the impregnated chips and the impregnation fluid;

the black liquor increasing a temperature of the chips mixture at the bottom of the impregnation vessel, the temperature of the black liquor being at least 135° C. in association with the withdrawal of the black liquor from the digester;

withdrawing a portion of a transfer fluid from the top of the digester;

leading the portion of the transfer fluid to a position where the transfer fluid is given time to work as impregnation fluid accounting for at least 25% of a total impregnation time for the cellulose chips disposed in the impregnation vessel, the portion of the transfer fluid passing a first indirect heat exchanger;

the first indirect heat exchanger indirectly subjecting the portion of the transfer fluid to a first fluid for a production of pure steam from the first fluid and for cooling of the portion of the transfer fluid;

leading the pure steam that is produced to a steam pre-treatment position, upstream of the impregnation vessel;

heating the chips at the steam pre-treatment position, and using the cooled transfer fluid as impregnation fluid in the impregnation vessel.

2. The method according to claim 1, wherein the pure steam is used for a steam pre-treatment at atmospheric pressure.

3. The method according to claim 1 wherein the pure steam is led to the impregnation vessel.

4. The method according to claim 3, wherein the transfer fluid withdrawn from the digester is led, after passage of the first indirect heat exchanger, to the impregnation vessel.

5. The method according to claim 4, wherein the transfer fluid withdrawn from the digester, after passage of the first indirect heat exchanger, also passes a cooling step before the transfer fluid is led to the impregnation vessel.

6. The method according to claim 5, wherein the cooling step is constituted by a second indirect heat exchanger, where the withdrawn transfer fluid exchanges heat indirectly with a second fluid.

7. The method according to claim 6, wherein the second fluid that is heated in the second indirect heat exchanger is led, after being heated, to the first indirect heat exchanger to be converted to pure steam.

8. The method according to claim 6 wherein fluid in the second indirect heat exchanger is constituted by water.

9. The method according to claim 5, wherein the cooling step is constituted by a flash tank that reduces a pressure of the transfer fluid withdrawn from the digester and reduces the temperature of the transfer fluid.

10. The method according to claim 1 wherein the pure steam is led to a steam pre-treatment vessel arranged upstream of the impregnation vessel, the chips are pre-treated with the pure steam in the pre-treatment vessel before being fed onwards to the impregnation vessel.

11. The method according to claim 10, wherein at least a part of the transfer fluid withdrawn from the digester is led, after passage of the first indirect heat exchanger, to the impregnation vessel.

12. The method according to claim 10 wherein at least a part of the transfer fluid withdrawn from the digester is led, after passage of the first indirect heat exchanger, to a fall-pipe, fall-pipe is arranged downstream of the steam pre-treatment vessel and upstream of the impregnation vessel.

13. The method according to claim 10 wherein fluid is withdrawn from a top separator at a top of the impregnation vessel and led to a fall-pipe.

14. The method according to claim 1 wherein the fluid in the first indirect heat exchanger is constituted by water and that the pure steam that is produced consists of pure water steam.

15. The method according to claim 1 wherein a subfraction of the transfer fluid withdrawn from the digester is led directly after the withdrawal of the transfer fluid to be mixed with the withdrawn black liquor further down in the digester.

* * * * *